US011250763B2

(12) United States Patent
Duan

(10) Patent No.: US 11,250,763 B2
(45) Date of Patent: Feb. 15, 2022

(54) PICTURE FRAME DISPLAY APPARATUS AND A DISPLAY METHOD

(71) Applicant: BOE Technology Group Co., Ltd., Beijing (CN)

(72) Inventor: Ran Duan, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/961,211

(22) PCT Filed: Jun. 21, 2019

(86) PCT No.: PCT/CN2019/092302
§ 371 (c)(1),
(2) Date: Jul. 9, 2020

(87) PCT Pub. No.: WO2020/252777
PCT Pub. Date: Dec. 24, 2020

(65) Prior Publication Data
US 2021/0166611 A1 Jun. 3, 2021

(51) Int. Cl.
*G09G 3/20* (2006.01)

(52) U.S. Cl.
CPC ..... *G09G 3/2092* (2013.01); *G09G 2310/08* (2013.01); *G09G 2340/0407* (2013.01);
(Continued)

(58) Field of Classification Search
CPC ..... G09G 2340/0407
See application file for complete search history.

(56) References Cited

U.S. PATENT DOCUMENTS 5,764,232 A 6/1998 Oouchi
10,482,847 B2 * 11/2019 Nakai ..... G09G 5/02
(Continued)

FOREIGN PATENT DOCUMENTS

CN 101527865 A 9/2009
CN 103974115 A 8/2014
(Continued)

OTHER PUBLICATIONS

International Search Report & Written Opinion dated Mar. 26, 2020, regarding PCT/CN2019/092302.

*Primary Examiner* — William Boddie
*Assistant Examiner* — Bipin Gyawali
(74) *Attorney, Agent, or Firm* — Intellectual Valley Law, P.C.

(57) ABSTRACT

The present application discloses a display apparatus including a solution-on-chip (SOC) comprising a first input port receiving video data, a second input port configured to receive image data in a first resolution, and a central-processing unit comprising a frame-cut block integrated with an image processor to divide a frame of image data in the first resolution to 4 parts of the frame in a second resolution in a serial order. The display apparatus further includes a FPGA configured to write, read, and process respective one of the 4 parts of the frame in the serial order sent from the SOC to reconstruct a frame of image data in the first resolution. Furthermore, the display apparatus includes a TCON configured to receive the frame of the image data in the first resolution reconstructed by the FPGA and a display panel driven by the TCON to display the frame of image data.

20 Claims, 4 Drawing Sheets

(52) U.S. Cl.
CPC ..... *G09G 2370/08* (2013.01); *G09G 2370/16* (2013.01); *G09G 2380/16* (2013.01)

(56) References Cited

U.S. PATENT DOCUMENTS

| | | | | |
|---|---|---|---|---|
| 2008/0094516 | A1* | 4/2008 | Lim | H04N 7/12 348/646 |
| 2009/0002297 | A1* | 1/2009 | Sakai | G09G 5/395 345/87 |
| 2011/0037785 | A1* | 2/2011 | Shiomi | G09G 3/3406 345/690 |
| 2014/0085314 | A1* | 3/2014 | Steinke | G06T 13/80 345/473 |
| 2015/0002739 | A1* | 1/2015 | Rui | H04N 21/440245 348/441 |
| 2015/0350619 | A1* | 12/2015 | Nakai | H04N 9/646 348/624 |
| 2016/0133224 | A1* | 5/2016 | Nakajima | G09G 5/005 348/445 |
| 2017/0019648 | A1* | 1/2017 | Yamaguchi | H04N 7/0132 |
| 2017/0111591 | A1* | 4/2017 | Ma | G06T 3/4038 |
| 2019/0251651 | A1* | 8/2019 | Chang | G06T 3/4053 |
| 2020/0275051 | A1* | 8/2020 | Chiang | H04N 7/014 |

FOREIGN PATENT DOCUMENTS

| | | | |
|---|---|---|---|
| CN | 105319936 | A | 2/2016 |
| EP | 1914988 | A2 | 4/2008 |

* cited by examiner

PICTURE FRAME DISPLAY APPARATUS AND A DISPLAY METHOD

CROSS-REFERENCE TO RELATED APPLICATION

This application is a national stage application under 35 U.S.C. § 371 of International Application No. PCT/CN2019/092302, filed Jun. 21, 2019, the contents of which are incorporated by reference in the entirety.

TECHNICAL FIELD

The present invention relates to display technology, more particularly, to a picture frame display apparatus and a display method.

BACKGROUND

The state of art 8K display products currently are using a field-programmable gate array (FPGA) to process image data transmission. The FPGA has advantages as being on-field programmable and capable of handling large amount of data resources. But, FPGA is also very expensive for the display apparatus without implementing a corresponding ASIC chip in 8K-resolution. Alternative low-cost solution is desired for displaying a picture in 8K-resolution based on an ASIC chip in 4K-resolution or 2K-resolution.

SUMMARY

In an aspect, the present disclosure provides a display apparatus. The display apparatus includes a solution-on-chip (SOC) including a display input port receiving video data, a data input port configured to receive image data in a first resolution, and a central processing unit (CPU) including a frame-cut block integrated with an image processor to divide a frame of the image data in the first resolution to 4 parts of the frame in a second resolution in a serial order, the SOC being interfaced with an external memory to save the image data in the first resolution. The first resolution is higher than the second resolution. The display apparatus further includes a field-programmable gate array (FPGA) configured to write, read, and process respective one of the 4 parts of the frame in the same serial order sent from the SOC to reconstruct a frame of image data in the first resolution. Additionally, the display apparatus includes a timing controller (TCON) configured to receive the frame of the image data in the first resolution reconstructed by the FPGA. Furthermore, the display apparatus includes a display panel driven by the TCON to display the frame of image data.

Optionally, the frame-cut block is configured to divide the frame of image data in the first resolution equally to a first part of a frame containing pixel data from a first row to a 2K-th row and from a first column to a 4K-th column, a second part of the frame containing pixel data from a first row to a 2K-th row and from a (4K+1)-th column to an 8K-th column, a third part of the frame containing pixel data from a (2K+1)-th row to a 4K-th row and from a first column to a 4K-th column, and a fourth part of the frame containing pixel data from a (2K+1)-th row to a 4K-th row and from a (4K+1)-th column to an 8K-th column.

Optionally, the frame-cut block is configured to divide the frame of image data in the first resolution equally to a first part of the frame assembled from pixel data in a (4 i+1)-th column in 4K rows, a second part of the frame assembled from pixel data in a (4 i+2)-th column in 4K rows, a third part of the frame assembled from pixel data in a (4 i+3)-th column in 4K rows, and a fourth part of the frame assembled from pixel data in a (4 i+4)-th column in 4K rows, where i varies from 0 to 2K−1.

Optionally, the frame-cut block is configured to divide the frame of image data in the first resolution equally to a first part of a frame containing pixel data from a first column to a 2K-th column in all 4K rows, a second part of the frame containing pixel data from a (2K+1)-th column to a 4K-th column in all 4K rows, a third part of the frame containing pixel data from a (4K+1)-th column to a 6K-th column in all 4K rows, and a fourth part of the frame containing pixel data from a (6K+1)-th column to an 8K-th column in all 4K rows.

Optionally, the frame-cut block is configured to encode a frame code to a frame of image data received from the data input port during a timing gap between transmitting two different rows of video data via a V-By-One channel, wherein the frame code is transferred by attaching ahead of the 4 parts of the frame of image data via the V-By-one channel to the FPGA.

Optionally, the frame code includes a 16 bit code with first 8 bit for recording a first serial number defining a respective one frame of image data and last 8 bit for recording a second serial number defining a respective part of the 4 parts of the frame divided by the frame-cut block.

Optionally, the FPGA is configured to receive the frame code about a frame of image in the first resolution with a first serial number and 4 parts of the frame divided in a serial order from the frame of image. The FPGA is configured to save the frame code to a second external memory based on the second serial number of the 4 parts of the frame. The FPGA is configured to generate a reconstructed frame of image data in the first resolution based on the serial order from the 4 parts of the frame by loading the 4 parts of the frame from the second external memory according to the second serial number, and to send the reconstructed frame of image data in the first resolution to the display panel via the TCON.

Optionally, the SOC includes a 4K normal-operation mode built in ASIC chip supporting transfer of video data in the second resolution to the FPGA in a frame rate of 60 Hz and an 8K picture-display mode supporting transfer of a frame of image data in the first resolution to the FPGA in ¼ of the frame rate by dividing to four parts of the image data stored in the second external memory.

Optionally, the FPGA includes a scaler block for stretching the video data in the second resolution to output a video signal in the first resolution in the frame rate of 60 Hz to the display panel via the TCON.

Optionally, the FPGA includes a memory controller interfaced with the second external memory, a WDMA write instance block for writing four parts of the image data in the second resolution including the frame code received from the SOC in the 8K picture-display mode to the second external memory, and a RDMA read instance block for loading the four parts of the image data in the second resolution including the frame code from the second external memory.

Optionally, the FPGA is configured to reconstruct a frame of image in the first resolution from the four parts of the image data in the second resolution based on the second serial number in the frame code. The FPGA is configured to repeatedly load the frame of image lastly reconstructed based on the first serial number in the frame code until a new frame of image in the first resolution via 4 parts of the frame is saved to the second external memory. The FPGA is configured to transfer the frame of image in the first resolution effectively in the frame rate of 60 Hz to the display panel via the TCON.

Optionally, the external memory includes a first DDR random access memory. The second external memory includes a second DDR random access memory.

Optionally, the second input port comprises a USB data port.

Optionally, the second input port comprises a WiFi interface for receiving image data wirelessly.

In another aspect, the present disclosure provides a method for using an ASIC solution-on-chip in a second resolution to transfer a frame of image in a first resolution to a display panel. The method includes receiving a frame of image data in the first resolution with a frame rate saved in an external memory. The method further includes loading a frame-cut function preprogrammed in CPU of the ASIC solution-on-chip to divide the frame of image data in the first resolution retrieved from the external memory to 4 parts of the frame in the second resolution. Additionally, the method includes encoding a frame code to the frame of image data to record a first serial number of the frame and a second serial number of a respective one of the 4 parts of the frame. The method also includes transferring the 4 parts of the frame including the frame code from the ASIC solution-on-chip to a field-programmable gate array (FPGA) in ¼ of the frame rate. The method further includes writing the 4 parts of the frame including the frame code to a second external memory in a serial order based on the second serial number. Furthermore, the method includes loading the 4 parts of frame from the second external memory to reconstruct the frame of image in the first resolution based on the frame code. The method still includes repeatedly loading the frame of image in the first resolution lastly reconstructed until a new frame of image in the first resolution is saved via saving 4 parts of the new frame to the second external memory. Moreover, the method includes transferring the frame of image in the first resolution via a Timing Controller (TCON) to drive a display panel to display a picture in the first resolution effectively with the frame rate based on the frame of image in the first resolution.

Optionally, the step of loading a frame-cut function preprogrammed in CPU of the ASIC solution-on-chip to divide the frame of image data in the first resolution to 4 parts of the frame in the second resolution includes dividing the frame of image into 4 equal parts during a timing gap between transferring two different rows of video data in 4K transmitting mode.

Optionally, the step of encoding the frame code includes generating a 16 bit code with first 8 bit for recording a first serial number defining a respective frame in the first resolution and last 8 bit for recording a second serial number of a respective one of the 4 parts of the frame divided by the frame-cut block. The 16 bit code is transferred from the frame-cut block of the SOC to the FPGA before transferring a first row of the respective one of the 4 parts of the frame.

Optionally, the step of transferring the 4 parts of the frame including the frame code includes sending a respective part of the frame in 4K-resolution via a V-By-One channel to the FPGA. The step of writing the 4 parts of the frame including the frame code to an external memory includes using a WDMA instance block in the FPGA to save the 4 parts of the frame to the second external memory in a serial order based on the second serial number in the frame code.

Optionally, the step of loading the 4 parts of frame from the second external memory includes using a RDMA instance block in the FPGA to read the 4 parts of the frame from the second external memory back to the FPGA in the same serial order to reconstruct the frame of image in the first resolution.

Optionally, the method further includes setting the ASIC solution-on-chip in a 4K normal-operation mode for transferring video data in the second resolution with a frame rate of 60 Hz, notifying the FPGA about the 4K normal-operation mode, employing a scaler to stretch image signal in the second resolution to the first resolution, and outputting the video data via the TCON to drive a scaled the first resolution video display on the display panel. Alternatively, the method includes setting the ASIC solution-on-chip in a first resolution picture-display mode for transferring the frame of image data in the first resolution with a frame rate of 60 Hz, notifying the FPGA about the first resolution picture-display mode, dividing the frame of image data to 4 parts, transferring the 4 parts to the FPGA in ¼ of the frame rate which saves the 4 parts to the second external memory, generating a reconstructed frame of image from the 4 parts loaded from the second external memory, loading the reconstructed frame of image repeatedly to effectively restore the frame rate, and outputting the reconstructed frame of image via the TCON to drive a first resolution picture display on the display panel.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

In general, dynamic image display needs at least a frame rate of 30 Hz or above to achieve a smooth viewing effect. The standard frame rate for 8K display must be 30 Hz or 60 Hz, or 120 Hz. For some special types of display products, such as picture frame display apparatus, its main function is for displaying a static image that is preferred in ultra-high resolution such as 8K-resolution and not very high frame rate from one image to another. For example, a picture frame display panel operated in a very fast image-switching mode may just need a frame rate of 1 Hz, i.e., switching an image every 1 second. Thus, a demand on handling large amount of image data in 8K-resolution for displaying an image in ultra-high 8K-resolution yet without requiring timely frame switch can be compensated by reconfiguring the image data in 8K-resolution to data in 4K-resolution with time-dimensional expansion and using 4K display processing system to handle data in 4K-resolution.

Figure 1:
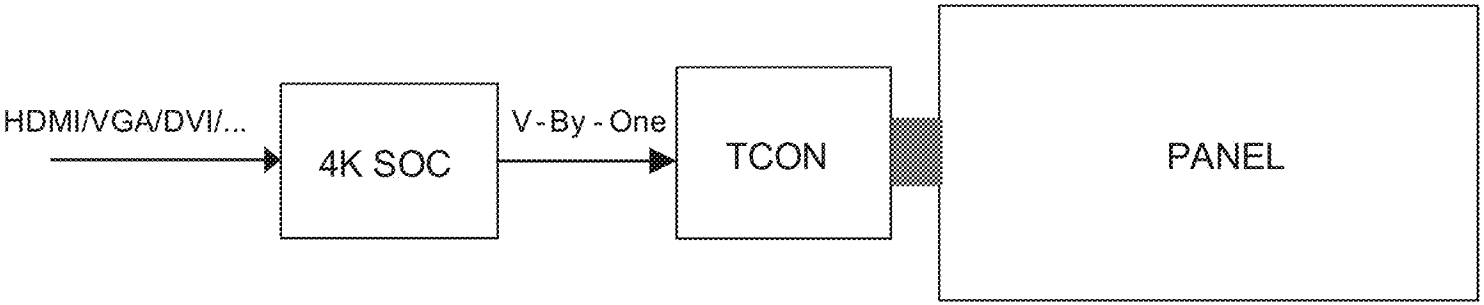
FIG. 1 is a block diagram of a display apparatus with conventional 4K display processing system.

FIG. 1 shows a block diagram of a display apparatus with conventional 4K display processing system. Referring to FIG. 1, the 4K display processing system includes a 4K solution-on-chip (SOC) unit configured as a standard application-specific integrated circuit (ASIC) chip to receive (dynamic) image data via a display input port, process the image data, and output video data signal via a V-By-One channel. The display input port includes but not limited to HDMI port, or a VGA port, or a DVI port. The V-By-One channel includes 8 Lanes to support data transmission in 4K-resolution with a frame rate of 60 Hz. The 4K SOC includes an ASIC circuit designed for processing 4K-resolution data packet and includes a central processing unit (CPU) configured to control data transmission flow and user interface. Optionally, the ASIC circuit includes input ports, output ports, and an image processing engine, which is built in as it is manufactured. Optionally, the 4K SOC shown in FIG. 1 can be replaced by low cost 2K SOC, which provides full HD image resolution (2048×1080) or at least in 1080 p full HD video signal.

The present disclosure provides, inter alia, a display apparatus and a method for using an ASIC solution-on-chip in a second resolution to transfer a frame of image in a first resolution to a display panel that substantially obviate one or more of the problems due to limitations and disadvantages of the related art. In some embodiments, the present disclosure provides a display apparatus. In some embodiments, the display apparatus includes a solution-on-chip (SOC) comprising a display input port receiving video data, a data input port configured to receive image data in a first resolution, and a central processing unit (CPU) comprising a frame-cut block integrated with an image processor to divide a frame of the image data in the first resolution to 4 parts of the frame in a second resolution in a serial order, the SOC being interfaced with an external memory to save the image data in the first resolution, the first resolution being higher than the second resolution; a field-programmable gate array (FPGA) configured to write, read, and process respective one of the 4 parts of the frame in the same serial order sent from the SOC to reconstruct a frame of image data in the first resolution; a timing controller (TCON) configured to receive the frame of the image data in the first resolution reconstructed by the FPGA; and a display panel driven by the TCON to display the frame of image data.

In one example, the first resolution is an 8K-resolution, referring to any resolution with a horizontal pixel count of approximately 8,000. The second resolution is a 4K-resolution, referring to refers to any resolution with a horizontal pixel count of approximately 4,000. In one example, the 8K-resolution denotes a resolution of 7,680×4,320, e.g., a total number of 7680×4320 subpixels. In another example, the 4K-resolution denotes a resolution of 4,096×2,160, e.g., a total number of 4096×2160 subpixels. Optionally, the first resolution is 4 times of the second resolution. In another example, the 2K-resolution denotes a resolution of 2,048×1,080, e.g., a total number of 2048×1080 subpixels. Optionally, the first resolution is a resolution of M×N subpixels, and the second resolution is a resolution of m×n subpixels, and optionally, M=2 m, and N=2 n, M, N, m, n, being integers.

Accordingly, the present disclosure provides, infer alia, a picture frame display apparatus for displaying image in 8K-resolution based on a 4K ASIC chip, and a display method thereof that substantially obviate one or more of the problems due to limitations and disadvantages of the related art. In one aspect, the present disclosure provides a display apparatus configured to use a 4K ASIC chip integrated with a frame-cut functional block for transmitting a frame of image in 8K-resolution to display an image to a picture frame display panel.

Figure 2:
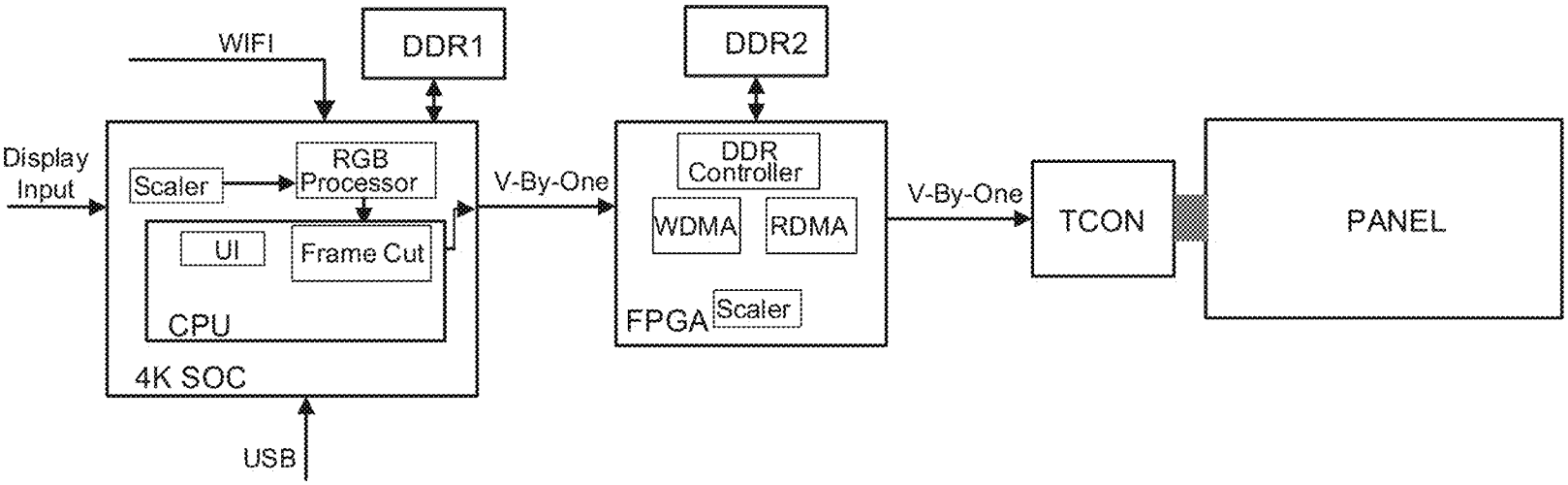
FIG. 2 is a block diagram of a display apparatus with an 8K picture-display processing system according to some embodiments of the present disclosure.

FIG. 2 shows a block diagram of a display apparatus with an 8K picture-display processing system according to some embodiments of the present disclosure. Referring to FIG. 2, the 8K picture-display processing system includes a 4K solution-on-chip (SOC) unit configured as an ASIC chip. The 4K SOC unit includes a display input port and one or more data input ports. The display input port includes one selected from a HDMI input port, a VGA input port, and a DVI input port, configured to receive video data. Optionally, the video data is in 4K-resolution. Optionally, the video data is transmitted with a frame rate of 60 Hz. The one or more data input ports include a USB port configured to transmit data including image data in all kinds of picture file format. Optionally, the one or more data input ports include a WIFI port. Optionally, the display apparatus is configured to display pictures based on the image data transmitted through either the WIFI port wirelessly or the USB port from a portable memory drive. Optionally, the display apparatus is configured as a picture frame display having the USB port or the WIFI port as its main image data input. The display input port such as HDMI/VGA/DVI port is used as a complementary video data input port.

Referring to FIG. 2, the 8K picture-display processing system also includes a central processing unit (CPU) built in the 4K SOC ASIC chip. The CPU is a programmable block including an interface sub-block for controlling user interface (UI) and data transmission flow to handle input and output of image data including the video data from the display input port or image data from the USB port or WIFI port. Optionally, the image data received from the USB port or WIFI port is a frame of image data in 8K-resolution to be displayed by the display apparatus.

In an embodiment, the CPU includes a frame-cut functional block integrated with an image processor (RGB processor) to divide the frame of the image data in 8K-resolution to 4 (or 2×2) parts of the frame in 4K-resolution. Optionally, the 4 parts of the frame in 4K-resolution are equally in packet size divided from the frame of image data in 8K-resolution. Optionally, the 4K SOC is interfaced with an external memory such as DDR random access memory (DDR1) and is configured to save the frame of image data in 8K-resolution to the external memory after receiving the frame of image data in 8K-resolution via the USB port or WIFI port. Optionally, the frame of the image data in 8K-resolution may be divided to 16 (or 4×4) parts of the frame in 2K-resolution and a 2K SOC may be used to handle each of the 16 divided parts of the frame for reconstructing a displayed image in 8K-resolution at a display panel. Alt functional operations would be substantially similar as the display apparatus of the present disclosure that utilizes a 4K SOC to handle the image data of 8K-resolution, except that there will be more variations in frame codes assigned for the divided 16 parts of one frame. Based on the frame codes, a field-programmable gate array (FPGA) can still be programmed to reconstruct the image in 8K-resolution. The following description will be focused on utilizing a 4K SOC for handling 4 divided parts of one frame of an 8K-resolution image.

Figure 3A:
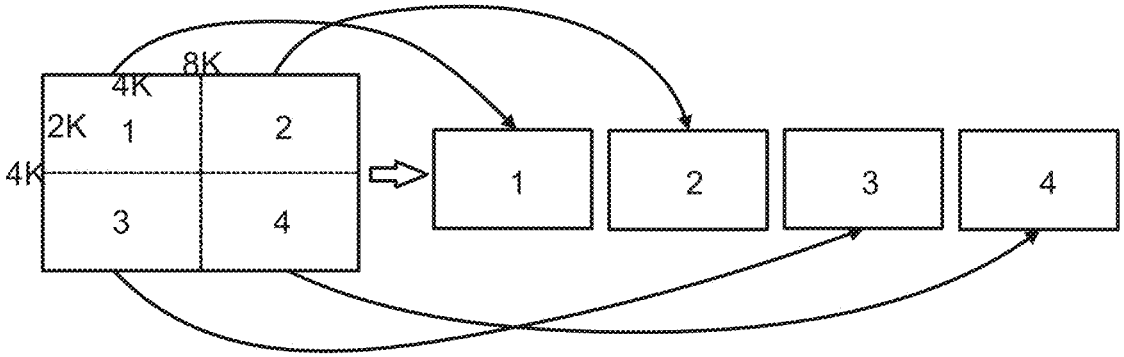
FIGS. 3A, 3B, and 3C are schematic diagrams of optionally dividing a frame of image in 8K-resolution to four parts of the frame in 4K-resolution according to some embodiments of the present disclosure.
Figure 3B:
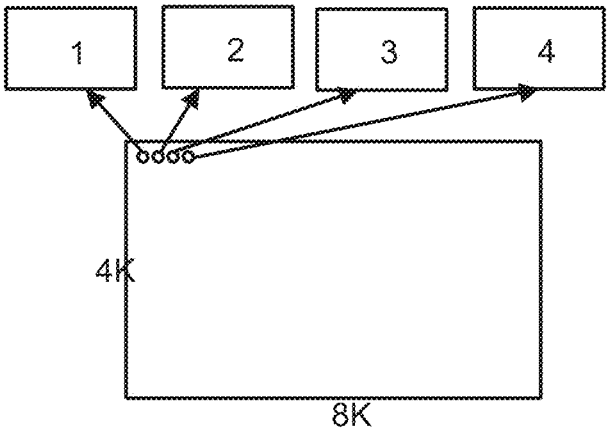
Figure 3C:
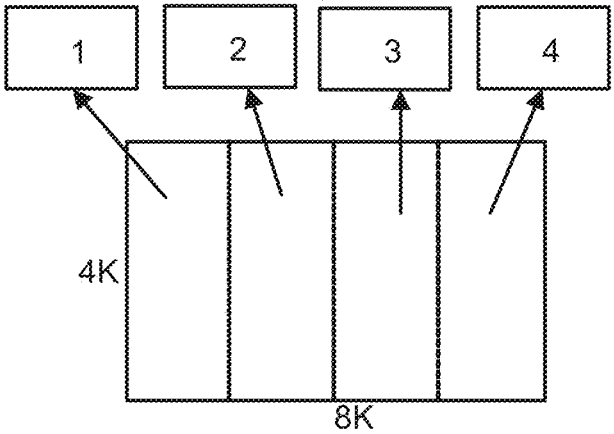

In the embodiment, the frame-cut block is configured to divide the frame of image data in 8K-resolution, temporally saved in the external memory DDR1, equally to 4 parts of the frame. FIGS. 3A, 3B, and 3C show schematic diagrams of optionally dividing a frame of image in 8K-resolution to four parts of the frame in 4K-resolution according to some embodiments of the present disclosure. Referring to FIG. 3A, optionally, the four parts of the frame includes a first part containing pixel data from a first row to a 2K-th row and from a first column to a 4K-th column of the frame of image data in 8K-resolution. Optionally, the four parts of the frame includes a second part containing pixel data from a first row to a 2K-th row and from a (4K+1)-th column to an 8K-th column of the frame of image data in 8K-resolution. Optionally, the four parts of the frame includes a third part containing pixel data from a (2K+1)-th row to a 4K-th row and from a first column to a 4K-th column of the frame of image data in 8K-resolution. Optionally, the four parts of the frame also includes a fourth part containing pixel data from a (2K+1)-th row to a 4K-th row and from a (4K+1)-th column to an 8K-th column of the frame of image data in 8K-resolution. Each part of the frame contains a packet of image data in 4K-resolution.

In an alternative embodiment, referring to FIG. 3B, the four parts of the frame divided from the frame of image data in 8K-resolution includes a first part of the frame assembled from pixel data in a (4 i+1)-th column in 4K rows, a second part of the frame assembled from pixel data in a (4 i+2)-th column in 4K rows, a third part of the frame assembled from pixel data in a (4 i+3)-th column in 4K rows, and a fourth part of the frame assembled from pixel data in a (4 i+4)-th column in 4K rows, where i varies from 0 to 2K−1. Each part of the frame contains a packet of image data in 4K-resolution.

In another alternative embodiment, referring to FIG. 3C, the four parts of the frame divided from the frame of image data in 8K-resolution includes a first part containing pixel data from a first column to a 2K-th column in all 4K rows of the frame of image data in 8K-resolution received by the 4K SOC, a second part containing pixel data from a (2K+1)-th column to a 4K-th column in all 4K rows of the frame of image data in 8K-resolution, a third part containing pixel data from a (4K+1)-th column to a 6K-th column in all 4K rows of the frame of image data in 8K-resolution, and a fourth part containing pixel data from a (6K+1)-th column to an 8K-th column in all 4K rows of the frame of image data in 8K-resolution. Each part of the frame contains a packet of image data in 4K-resolution.

Of course, there can be many ways, other than those shown above, to divide the frame of image data in 8K-resolution by the frame-cut functional block, which can be programmed according to requirements of picture display applications. In the embodiments, the frame-cut block is configured to encode a frame code to a frame of image data received from the data input port, such as USB port, during a timing gap between transmitting two different rows of video data by the 4K SOC via a V-By-One channel. Since each frame of image data in 8K-resolution retrieved from the external memory DDR1 is divided by the frame-cut block (a pre-saved processing program) to four parts of the frame in 4K-resolution, each part is transmitted in a serial order through the V-By-One channel. The frame rate of original image data in 8K-resolution is thus reduced to ¼ or lower. However, the frame rate for displaying the image in static mode is not an issue in display quality. Alternatively, the same frame of image may be reloaded repeatedly to substantially restore the frame rate effectively.

Figure 4:
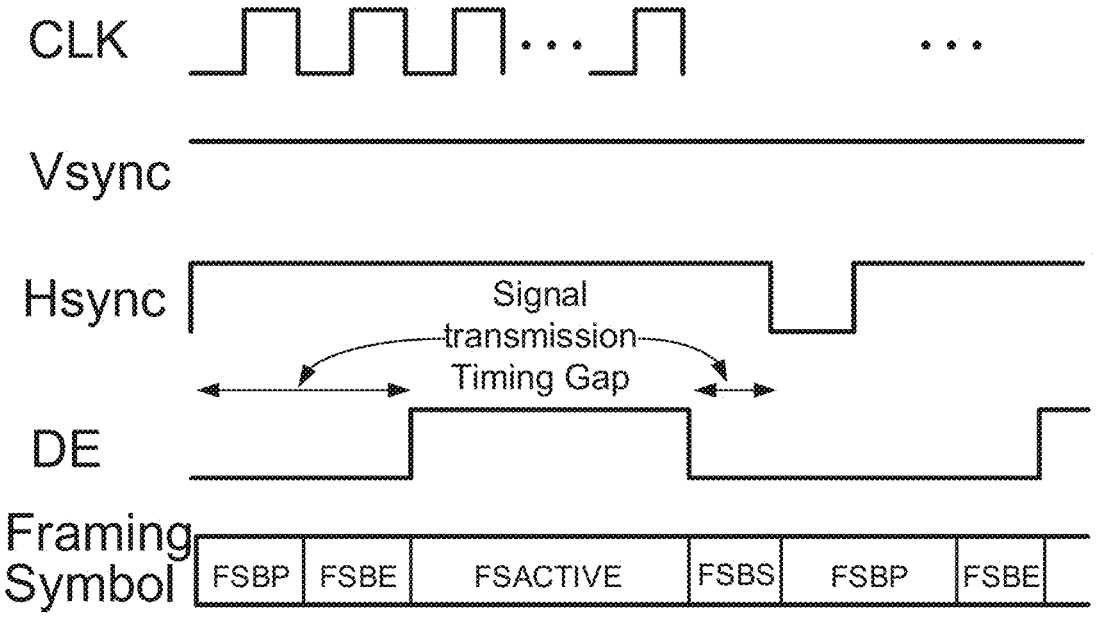
FIG. 4 is a timing diagram of encoding a frame code for a frame of image in 8K-resolution during signal transmission tuning gap of transmitting video signals in 4K-resolution according to an embodiment of the present disclosure.

In another embodiment, the frame-cut functional block, when it performs dividing one of series of frames of image data in 8K-resolution to four equal parts, is configured to encode a frame code for identifying the respective one frame in the serials and further identifying a respective part in the four equal parts being divided. FIG. 4 shows a schematic timing diagram of encoding a frame code during signal transmission timing gap of transmitting video signals according to an embodiment of the present disclosure. Referring to FIG. 4, the video signals are, received via the display input port of the 4K SOC, generally transmitted according to a timing set by a clock signal CLK. Each row of data of a frame is transmitted under a control of a horizontal synchronize signal Hsync. Each frame of data is finished its transmission under a control of a vertical synchronize signal Vsync. Each frame of data has an active transmission or display period defined as FSACTIVE enabled by a data-enable signal DE. After the active period, a blank period FSBP starts with a first pixel timing period of FSBS and ends with a last pixel timing period FSBE. There always are transmission timing gap between transmitting two different rows of data in two active periods. The timing gap includes one FSBE period in front of a front shoulder and also one FSBS period behind a back shoulder of an actively transmitted packet of one row of data determined by the data-enable signal DE. In the embodiment, the frame-cut functional block is configured to encode the frame code during the timing gap. The frame code associated with a particular frame of image in 8K-resolution can be attached ahead of a first row of to a whole data packet for the frame of image to be transmitted.

Figure 5:
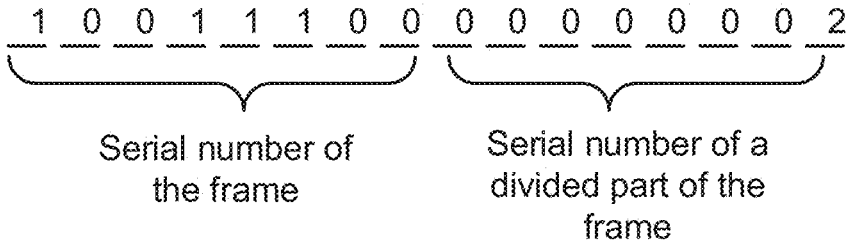
FIG. 5 is an exemplary diagram of a 16 bit frame code with first 8 bit to define a first serial number of the frame and last 8 bit to define a second serial number of one divided part of the frame according to an embodiment of the present disclosure.

In a specific embodiment, the frame code is encoded as following scheme for identifying the frame of image in 8K-resolution as well as each part divided thereof. FIG. 5 shows an exemplary diagram of a 16 bit frame code with first 8 bit to define a first serial number of the frame and last 8 bit to define a second serial number of one divided part of the frame according to an embodiment of the present disclosure. Referring to FIG. 5, the frame code is represented by a 16 bit code with first 8 bit for recording a first serial number defining a respective one frame of image data (in a series and last 8 bit for recording a second serial number defining a respective part of the 4 parts of the frame divided by the frame-cut block. That the 8 bit for recording the first serial number of each frame suggests total 256 frames can be recorded. The first serial number will restart from 0 after a maximum of the 256-th frame is recorded. The last 8 bit in FIG. 5 shows that this is a second part that divided from the frame.

Referring back to the FIG. 2, the 8K picture-display processing system of the display apparatus further includes a field-programmable gate array (FPGA) configured to write, read, and process respective one of the four parts of the frame in the same serial order sent from the 4K SOC to reconstruct a frame of image data in 8K-resolution. In particular, the FPGA includes a DDR controller configured to interface with a second external memory (i.e., a second DDR random access memory, denoted as DDR2). The FPGA is configured to receive data packets including the frame code sent by V-By-One channel from the 4K SOC. Optionally, the frame code is transferred by attaching ahead of a 4K data packet of the four pails of the frame of image data via the V-By-one channel to the FPGA. Optionally, each frame of image in 8K-resolution, identified by the first serial number in the frame code, is effectively sent through four parts of the frame in 4K-resolution in a series of four packets respectively identified by the second serial number in the frame code. Optionally, the FPGA includes a write instance block WDMA configured to form a direct memory access link for FPGA to save data of the four parts of frame including the frame code into the second external memory in an order based on the second serial number in the frame code. The FPGA is configured to firstly find the frame code before a first row of image data being received. Then, the FPGA is using the WDMA to save the respective part of the frame into the second external memory DDR2 according to the second serial number in the frame code. Additionally, the FPGA includes a read instance block RDMA configured to form another direct memory access link for FPGA to read data of the four parts of frame saved in the second external memory DDR2. The FPGA further is configured to generate a reconstructed frame of image data in 8K-resolution based on the same serial order of dividing it to the four parts of the frame by loading the four parts of the frame from the second external memory DDR2 according to the order set by the second serial number in the frame code. The reconstructed frame of image data has a same ultra-high resolution as the original frame of image data retrieved from the external memory DDR1 (inputted from the data input port), which can be displayed on the display panel though the frame rate is somewhat lowered.

Referring to FIG. 2, the 8K picture-display processing system of the display apparatus additionally includes a timing controller (TCON) configured to receive the image data from the FPGA and to drive the display panel to display the image based on the timing control determined by the TCON. In the embodiment, once the reconstructed frame of image data in 8K-resolution is generated by the FPGA, it can be transported to the display panel via the TCON.

In a specific embodiment, assuming the display panel supports a 60 Hz frame rate for displaying an 8K-resolution image, while the 4K SOC is transmitting the data through divide-reconstruct scheme in 4K transmission with only 15 frames in one second, a frame rate of 60/4 Hz. After the 4K SOC finishes its transmission of one frame of image data in 8K-resolution sequentially via 4 parts of one frame in 4K-resolution, the FPGA can repeatedly load the same frame of image by keeping read data latest saved in the second external memory DDR2 until the FPGA receives a new frame of image from the 4K SOC. In this way, the same frame of image can be transported to the display panel to display the picture in 60 Hz effectively, though actual picture is refreshed in lower rate. But, the picture is still displayed in ultra-high 8K resolution.

Optionally, referring to FIG. 2, the FPGA includes a scaler block configured to stretch one 4K-resolution image data of a series of frames of video signals in 60 Hz frame rate sent from the 4K SOC controlled by the user interface (UI) in a normal-operation (video-display) mode. These video signals are received from display input port. The 4K SOC includes a chip-to-chip communication interface (such as $I^2C$) to notify the FPGA that these data are normal 4K-resolution data. The FPGA then is configured to enable the scaler block for directly stretching each frame of image data in 4K-resolution to (pretended) 8K-resolution. The image data in stretched 8K-resolution is then sent via TCON to the display panel for directly displaying the video image in stretched 8K-resolution with 60 Hz. Alternatively, if the 4K SOC is controlled by UI to an 8K picture-display mode, the 4K SOC can notify the FPGA about the mode through $I^2C$ communication interface. Then, the FPGA is ready to process the 4 parts of a frame in 4K-resolution divided from one frame of image data in 8K-resolution and reconstruct to a frame of image in 8K-resolution before transporting to the display panel to display a picture in 8K-resolution.

In an alternative aspect, the present disclosure provides a method for using an ASIC solution-on-chip (SOC) in 4K-resolution to transfer a frame of image in 8K-resolution to a display panel for displaying image in 8K-resolution. In some embodiments, the method includes receiving a frame of image data in the first resolution with a frame rate saved in an external memory; loading a frame-cut function pre-programmed in CPU of the ASIC solution-on-chip to divide the frame of image data in the first resolution retrieved from the external memory to 4 parts of the frame in the second resolution; encoding a frame code to the frame of image data to record a first serial number of the frame and a second serial number of a respective one of the 4 parts of the frame; transferring the 4 parts of the frame including the frame code from the ASIC solution-on-chip to a field-programmable gate array (FPGA) in ¼ of the frame rate; writing the 4 parts of the frame including the frame code to a second external memory in a serial order based on the second serial number; loading the 4 parts of frame from the second external memory to reconstruct the frame of image in the first resolution based on the frame code; repeatedly loading the frame of image in the first resolution lastly reconstructed until anew frame of image in the first resolution is saved via saving 4 parts of the new frame to the second external memory and transferring the frame of image in the first resolution via a Timing Controller (TCON) to drive a display panel to display a picture in the first resolution effectively with the frame rate based on the frame of image in the first resolution.

In one example, the first resolution is an 8K-resolution, and the second resolution is a 4K-resolution. In one example, the 8K-resolution denotes a resolution of 7,680×4,320, e.g., a total number of 7,680×4,320 subpixels. In another example, the 4K-resolution denotes a resolution of 3,840×2160, e.g., a total number of 3,840×2160 subpixels. Optionally, the first resolution is 4 times of the second resolution. Optionally, the first resolution is a resolution of M×N subpixels, and the second resolution is a resolution of m×n subpixels, and optionally, M=2 m, and N=2 n, M, N, m, n, being integers.

In one specific example, the method includes receiving a frame of image data in 8K-resolution with a frame rate by the ASIC SOC in 4K-resolution. The ASIC SOC in 4K-resolution is part of the display apparatus intended for displaying a picture in 8K-resolution based on the frame of image data. Optionally, the frame rate may be 60 Hz. The method further includes loading a frame-cut function preprogrammed in CPU of the ASIC SOC to divide the frame of image data in 8K-resolution to 4 parts of a frame in 4K-resolution. Additionally, the method includes encoding a frame code to the frame of image data to record a first serial number of the frame and a second serial number of a respective one of the 4 parts of the frame. The method further includes transferring the 4 parts of the frame including the frame code from the ASIC SOC to a field-programmable gate array (FPGA) in ¼ of the frame rate. The method also includes writing the 4 parts of the frame including the frame code to a second external memory in a serial order based on the second serial number and loading the 4 parts of frame from the second external memory to reconstruct the frame of image in 8K-resolution based on the serial order. Furthermore, the method includes repeatedly loading the frame of image in 8K-resolution lastly reconstructed until a new frame of image in 8K-resolution is saved via saving 4 parts of the new frame to the second external memory. Moreover, the method includes transferring the frame of image in 8K-resolution via a Timing Controller (TCON) to drive a display panel to display a picture in 8K-resolution effectively with the frame rate based on the frame of image in 8K-resolution.

In an embodiment, the step of loading a frame-cut function preprogrammed in CPU of the ASIC solution-on-chip to divide the frame of image data in 8K-resolution retrieved from the external memory to 4 parts of the frame in 4K-resolution includes dividing the frame of image in 8K-resolution into 4 equal parts in 4K-resolution during a timing gap between transferring two different rows of video data in 4K transmitting mode.

In an embodiment, the step of encoding the frame code includes generating a 16 bit code with first 8 bit for recording a first serial number defining a respective frame in 8K-resolution and last 8 bit for recording a second serial number of a respective one of the 4 parts of the frame in 4K-resolution divided by the frame-cut block. The 16 bit code is transferred from the frame-cut block of the ASIC SOC to the FPGA before transferring a first row of the respective one of the 4 parts of the frame in 4K-resolution.

In an embodiment, the step of transferring the 4 parts of the frame including the frame code includes sending a respective part of the frame in 4K-resolution via a V-By-One channel to the FPGA. The step of writing the 4 parts of the frame including the frame code to a second external memory includes using a WDMA instance block in the FPGA to save the 4 parts of the frame in 4K-resolution to the second external memory in a serial order based on the second serial number in the frame code.

In an embodiment, the step of loading the 4 parts of frame from the second external memory includes using a RDMA instance block in the FPGA to read the 4 parts of the frame in 4K-resolution from the second external memory back to the FPGA in the same serial order to reconstruct the frame of image in 8K-resolution.

In an embodiment, the method of displaying picture in 8K-resolution using a 4K ASIC SOC to transfer the image data further includes setting the ASIC SOC in a 4K normal-operation mode for transferring video data in 4K-resolution with a frame rate of 60 Hz. The method then includes notifying the FPGA about the 4K normal-operation mode, employing a scaler to stretch image signal in 4K-resolution to 8K-resolution, and outputting the video data via the TCON to drive the display panel to display a scaled 8K-resolution video. Alternatively the method of displaying picture in 8K-resolution using a 4K ASIC SOC to transfer the image data further includes setting the ASIC SOC in an 8K-resolution picture-display mode for transferring the frame of image data in 8K-resolution with a frame rate and notifying the FPGA about the 8K-resolution picture-display mode, dividing the frame of image data to 4 parts. The method further includes transferring the 4 parts to the FPGA in ¼ of the frame rate which saves the 4 parts to the second external memory. The method also includes generating a reconstructed frame of image from the 4 parts loaded from the second external memory, loading the reconstructed frame of image repeatedly to effectively restore the frame rate, and outputting the reconstructed frame of image via the TCON to drive the display panel to display a picture in 8K resolution.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A display apparatus comprising:

a solution-on-chip (SOC) comprising a display input port receiving video data, a data input port configured to receive image data in a first resolution with a frame rate, and a central processing unit (CPU) comprising a frame-cut block integrated with an image processor to divide a frame of the image data in the first resolution to P number of parts of the frame of the image data in a second resolution in a serial order, the SOC being interfaced with an external memory to save the image data in the first resolution, the first resolution being higher than the second resolution, P being equal to or an integer multiple of 4;

a field-programmable gate array (FPGA) configured to write, read, and process respective one of the P number of parts of the frame in the same serial order sent from the SOC to reconstruct a frame of image data in the first resolution;

a timing controller (TCON) configured to receive the frame of the image data in the first resolution reconstructed by the FPGA; and a display panel driven by the TCON to display the frame of image data;

wherein, in an 8K picture-display mode, the SOC is configured to transfer the P number of parts of the frame of the image data in 1/P of the frame rate;

the FPGA is configured to:

store the P number of parts of the frame of the image data in a second external memory;

reconstruct a reconstructed frame of image in the first resolution from the P number of parts of the frame of the image data in the second resolution;

repeatedly load a same reconstructed frame of image lastly reconstructed until a next reconstructed frame of image in the first resolution reconstructed from P number of parts of a next frame of the image data is saved onto the second external memory; and transfer the frame of image in the first resolution effectively in the frame rate to the display panel via the TCON.

2. The display apparatus of claim 1, wherein the frame-cut block is configured to divide the frame of image data in the first resolution equally to a first part of a frame containing pixel data from a first row to a 2K-th row and from a first column to a 4K-th column, a second part of the frame containing pixel data from a first row to a 2K-th row and from a (4K+1)-th column to an 8K-th column, a third part of the frame containing pixel data from a (2K+1)-th row to a 4K-th row and from a first column to a 4K-th column, and a fourth part of the frame containing pixel data from a (2K+1)-th row to a 4K-th row and from a (4K+1)-th column to an 8K-th column.

3. The display apparatus of claim 1, wherein the frame-cut block is configured to divide the frame of image data in the first resolution equally to a first part of the frame assembled from pixel data in a (4i+1)-th column in 4K rows, a second part of the frame assembled from pixel data in a (4i+2)-th column in 4K rows, a third part of the frame assembled from pixel data in a (4i+3)-th column in 4K rows, and a fourth part of the frame assembled from pixel data in a (4i+4)-th column in 4K rows, where i varies from 0 to 2K−1.

4. The display apparatus of claim 1, wherein the frame-cut block is configured to divide the frame of image data in the first resolution equally to a first part of a frame containing pixel data from a first column to a 2K-th column in all 4K rows, a second part of the frame containing pixel data from a (2K+1)-th column to a 4K-th column in all 4K rows, a third part of the frame containing pixel data from a (4K+1)-th column to a 6K-th column in all 4K rows, and a fourth part of the frame containing pixel data from a (6K+1)-th column to an 8K-th column in all 4K rows.

5. The display apparatus of claim 1, wherein the frame-cut block is configured to encode a frame code to a frame of image data received from the data input port during a timing gap between transmitting two different rows of video data via a V-By-One channel, wherein the frame code is transferred by attaching the frame code to a position ahead of the P number of parts of the frame of image data via the V-By-one channel to the FPGA.

6. The display apparatus of claim 5, wherein the frame code comprises a first portion corresponding to a first serial number defining a respective one frame of image data and a second portion corresponding to a second serial number defining a respective part of the P number of parts of the frame divided by the frame-cut block.

7. The display apparatus of claim 6, wherein the FPGA is configured to receive the frame code, and to save the frame code to the second external memory;

wherein reconstructing the reconstructed frame of image in the first resolution from the P number of parts of the frame of the image data in the second resolution comprises loading the P number of parts of the frame of the image data from the second external memory according to the second serial number.

8. The display apparatus of claim 7, wherein, in a 4K normal-operation mode, the SOC is configured to transfer of video data in the second resolution to the FPGA in the frame rate.

9. The display apparatus of claim 8, wherein the FPGA comprises a scaler block configured to, in the 4K normal-operation mode, stretch the video data in the second resolution to output a video signal in the first resolution in the frame rate to the display panel via the TCON.

10. The display apparatus of claim 1, wherein the FPGA comprises a memory controller interfaced with the second external memory, a WDMA write instance block configure to write four parts of the image data in the second resolution including the frame code received from the SOC in the 8K picture-display mode to the second external memory, and a RDMA read instance block configured to load the four parts of the image data in the second resolution including the frame code from the second external memory.

11. The display apparatus of claim 1, wherein the external memory comprises a first DDR random access memory, the second external memory comprises a second DDR random access memory.

12. The display apparatus of claim 1, wherein the data input port comprises a USB data port.

13. The display apparatus of claim 1, wherein the data input port comprises a WiFi interface for receiving image data wirelessly.

14. A method for using an ASIC solution-on-chip in a second resolution to transfer a frame of image in a first resolution to a display panel, comprising:

receiving a frame of image data in the first resolution with a frame rate saved in an external memory;

loading a frame-cut function preprogrammed in CPU of the ASIC solution-on-chip to divide the frame of image data in the first resolution retrieved from the external memory to P number of parts of the frame of the image data in the second resolution, P being equal to or an integer multiple of 4;

transferring the P number of parts of the frame including the frame code from the ASIC solution-on-chip to a field-programmable gate array (FPGA) in 1/4 of the frame rate;

writing the P number of parts of the frame including the frame code to a second external memory in a serial order;

reconstructing a reconstructed frame of image in the first resolution from the P number of parts of the frame of the image data in the second resolution;

repeatedly loading a same reconstructed frame of image lastly reconstructed until a next reconstructed frame of image in the first resolution reconstructed from P number of parts of a next frame of the image data is saved via saving the P number of parts of the next reconstructed frame to the second external memory; and transferring the frame of image in the first resolution via a Timing Controller (TCON) to drive a display panel to display a picture in the first resolution effectively with the frame rate based on the frame of image in the first resolution.

15. The method of claim 14, further comprising encoding a frame code to the frame of image data to record a first serial number of the frame and a second serial number of a respective one of the P number of parts of the frame during a timing gap between transferring two different rows of video data in 4K transmitting mode.

16. The method of claim 15, wherein encoding the frame code comprises generating a first portion corresponding to a first serial number defining a respective frame in the first resolution and generating a second portion corresponding to a second serial number of a respective one of the P number of parts of the frame divided by the frame-cut block, wherein the frame code is transferred from the frame-cut block of the SOC to the FPGA before transferring a first row of the respective one of the P number of parts of the frame.

17. The method of claim 16, wherein transferring the P number of parts of the frame of the image data including the frame code comprises sending a respective part of the frame of the image data in 4K-resolution via a V-By-One channel to the FPGA, wherein writing the P number of parts of the frame of the image data including the frame code to an external memory comprises using a WDMA instance block in the FPGA to save the P number of parts of the frame of the image data to the second external memory in a serial order based on the second serial number in the frame code.

18. The method of claim 17, wherein loading the P number of parts of frame of the image data from the second external memory comprises using a RDMA instance block in the FPGA to read the P number of parts of the frame of the image data from the second external memory back to the FPGA in the same serial order to reconstruct the frame of image in the first resolution.

19. The method of claim 14, further comprises setting the ASIC solution-on-chip in a 4K normal-operation mode for transferring video data in the second resolution with the frame rate, notifying the FPGA about the 4K normal-operation mode, employing a scaler to stretch image signal in the second resolution to the first resolution, and outputting the video data via the TCON to drive a scaled the first resolution video display on the display panel.

20. The method of claim 14, further comprises setting the ASIC solution-on-chip in a first resolution picture-display mode for transferring the frame of image data in the first resolution with the frame rate, notifying the FPGA about the first resolution picture-display mode, dividing the frame of image data to the P number of parts, transferring the P number of parts to the FPGA in 1/P of the frame rate which saves the P number of parts to the second external memory, generating a reconstructed frame of image from the P number of parts loaded from the second external memory, loading the reconstructed frame of image repeatedly to effectively restore the frame rate, and outputting the reconstructed frame of image via the TCON to drive a first resolution picture display on the display panel.

* * * * *